US008814576B2

(12) United States Patent
Yoshida et al.

(10) Patent No.: US 8,814,576 B2
(45) Date of Patent: Aug. 26, 2014

(54) CONNECTOR AND STRUCTURE FOR CONNECTING CIRCUIT BOARD AND EXTERNAL CONNECTOR

(75) Inventors: Mikio Yoshida, Kariya (JP); Masanori Tsuzuki, Kariya (JP); Shingo Enami, Kariya (JP); Yusuke Kinoshita, Kariya (JP)

(73) Assignee: Kabushiki Kaisha Toyota Jidoshokki, Aichi (JP)

( * ) Notice: Subject to any disclaimer, the term of this patent is extended or adjusted under 35 U.S.C. 154(b) by 98 days.

(21) Appl. No.: 13/563,075

(22) Filed: Jul. 31, 2012

(65) Prior Publication Data

US 2013/0034975 A1 Feb. 7, 2013

(30) Foreign Application Priority Data

Aug. 1, 2011 (JP) ..... 2011-168527

(51) Int. Cl.
*H01R 12/00* (2006.01)

(52) U.S. Cl.
USPC ..... 439/76.1; 439/83

(58) Field of Classification Search
USPC ..... 439/76.1, 76.2, 78, 83; 361/752
See application file for complete search history.

(56) References Cited

U.S. PATENT DOCUMENTS

| | | | | |
|---|---|---|---|---|
| 6,808,397 | B2 * | 10/2004 | Kondo | 439/76.2 |
| 6,991,494 | B1 * | 1/2006 | Spink, Jr. | 439/607.27 |
| 7,189,082 | B2 * | 3/2007 | Fukushima et al. | 439/76.2 |
| 7,561,435 | B2 * | 7/2009 | Kamoshida et al. | 361/752 |
| 7,755,907 | B2 * | 7/2010 | Inagaki | 361/752 |
| 8,023,273 | B2 * | 9/2011 | Chlumsky et al. | 361/752 |
| 8,342,861 | B2 * | 1/2013 | Stiehl et al. | 439/76.1 |
| 2003/0086800 | A1 | 5/2003 | Kurihara et al. | |
| 2006/0089018 | A1 | 4/2006 | Orita et al. | |
| 2006/0279316 | A1 | 12/2006 | Sato et al. | |
| 2011/0175470 | A1 | 7/2011 | Kinoshita et al. | |

FOREIGN PATENT DOCUMENTS

| | | | |
|---|---|---|---|
| JP | 56-067677 | U | 6/1981 |
| JP | 62-096275 | U | 6/1987 |
| JP | 07-034559 | U | 6/1995 |
| JP | 11-154542 | A | 6/1999 |
| JP | 2003-148343 | A | 5/2003 |
| JP | 2005-056805 | A | 3/2005 |
| JP | 2005-282551 | A | 10/2005 |
| JP | 2006-120448 | A | 5/2006 |
| JP | 2006-344458 | A | 12/2006 |
| JP | 2008-175069 | A | 7/2008 |
| JP | 2009-129576 | A | 6/2009 |
| JP | 2009-243347 | A | 10/2009 |
| JP | 2011-144788 | A | 7/2011 |
| KR | 20110084832 | A | 7/2011 |

OTHER PUBLICATIONS

Japanese Office Action for corresponding JP Patent Application No. 2011-168527 dated Jun. 11, 2013.

* cited by examiner

*Primary Examiner* — Thanh Tam Le
(74) *Attorney, Agent, or Firm* — Sughrue Mion, PLLC

(57) ABSTRACT

A structure for connecting a circuit board and an external connector includes a lead and a stress dampening unit. The lead electrically connects the circuit board and the external connector. The external connector is fitted to and removed from the lead. The stress dampening unit dampens stress applied to the circuit board by the lead when the external connector is fitted to and removed from the lead.

8 Claims, 5 Drawing Sheets

CONNECTOR AND STRUCTURE FOR CONNECTING CIRCUIT BOARD AND EXTERNAL CONNECTOR

BACKGROUND OF THE INVENTION

The present invention relates to a structure for connecting a circuit board and an external connector and to a connector connected to an external connector.

Japanese Laid-Open Patent Publication No. 2006-344458 discloses a structure for connecting a wiring board (circuit board), which uses a surface mounting type electrical connector contact (lead), to a mated electrical connector (external connector). The contact of the surface mounting type electrical connector includes one end defining a bonding portion, which is bonded by solder to a contact pad of the wiring board, and another end defining a connecting portion, which contacts a contact of the mated electrical connector. The bonding portion is bonded by solder to the contact pad and the connecting portion is arranged in contact with the contact of the mated electrical connector. This electrically connects the wiring board and the mated electrical connector through the surface mounting type electrical connector contact.

In the structure of Japanese Laid-Open Patent Publication No. 2006-344458, when the mated electrical connector is fitted to and removed from the contact of the surface mounting type electrical connector, force acts on the contact. The force acting on the contact is applied as stress to the wiring board. This may damage the wiring board.

SUMMARY OF THE INVENTION

The present invention provides a connector and a structure for connecting a circuit board and an external connector that dampen the stress applied to the circuit board through a lead when an external connector is fitted to and removed from the lead.

One aspect of the present invention is a structure for connecting a circuit board and an external connector. The structure includes a lead that electrically connects the circuit board and the external connector. The external connector is fitted to and removed from the lead. A stress dampening unit dampens stress applied to the circuit board by the lead when the external connector is fitted to and removed from the lead.

A further aspect of the present invention is a connector including a lead that electrically connects a circuit board and an external connector. The external connector is fitted to and removed from the lead. A connector coupler is connected with the external connector. A stress dampening unit dampens stress applied to the circuit board by the lead when the external connector is fitted to and removed from the lead.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First Embodiment

A first embodiment of the present invention will now be described with reference to FIGS. 1 and 2.

Figure 1A:
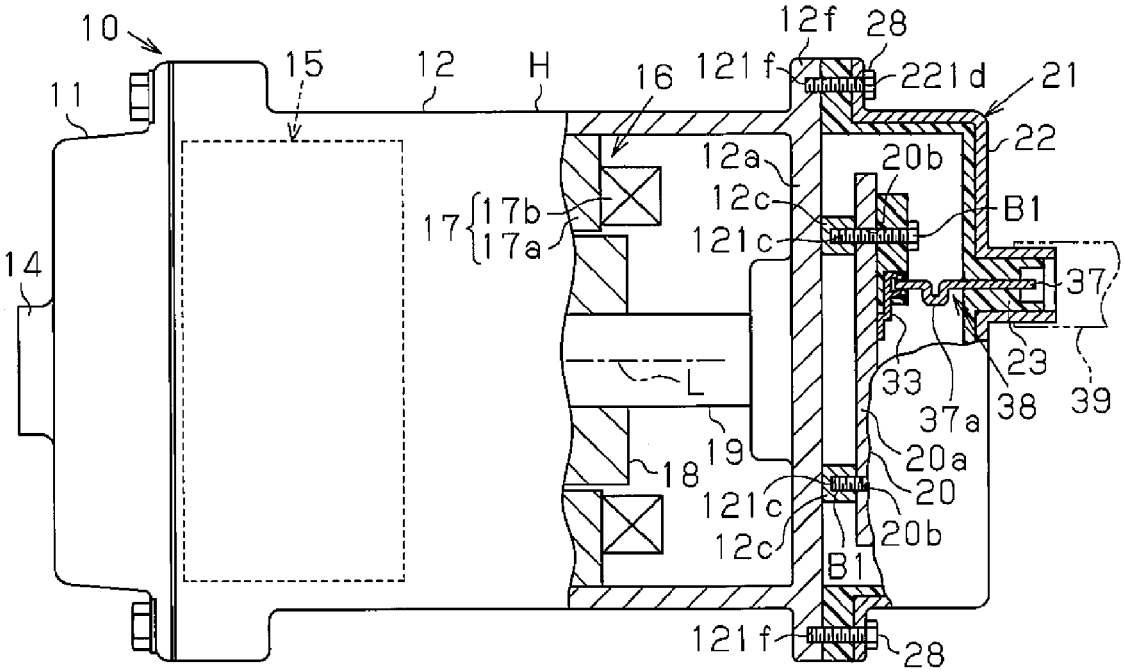
FIG. 1A is a partially cut-away cross-sectional view showing an electric compressor according to a first embodiment of the present invention.

As shown in FIG. 1A, a housing H of an electric compressor 10 includes a cylindrical discharge housing 11, which is located at the left side as viewed in FIG. 1A, and a cylindrical suction housing 12, which is coupled with the discharge housing 11. Each of the discharge and suction housings 11 and 12 is formed from aluminum and includes a closed end. A suction port (not shown) is formed in a bottom wall of the suction housing 12 and connected to an external refrigerant circuit (not shown). A discharge port 14 is formed on the closed end (left side as viewed in FIG. 1A) of the discharge housing 11 and connected to the external refrigerant circuit.

The suction housing 12 accommodates a compression unit 15 (shown by broken lines in FIG. 1A), which compresses refrigerant, and an electric motor 16, which serves as a drive unit that drives the compression unit 15. In the present embodiment, although not shown in the drawings, the compression unit 15 includes a fixed scroll, which is fixed in the suction housing 12, and a movable scroll, which is arranged in a manner interleaved with the fixed scroll.

A stator 17 is fixed to an inner circumferential surface of the suction housing 12. The stator 17 includes a stator core 17*a*, which is fixed to the inner circumferential surface of the suction housing 12 and includes teeth (not shown), and a coil 17*b*, which is wound around the teeth of the stator core 17*a*. A rotary shaft 19, which extends through the stator 17, is rotatably supported by the suction housing 12. A rotor 18 is fixed to the rotary shaft 19.

A flange 12*f* extends outward from the circumferential wall of the suction housing 12 in a direction perpendicular to the axis L of the rotary shaft 19. The flange 12*f* extends around the entire circumferential wall and is continuous with an end wall 12*a* of the suction housing 12. The flange 12*f* includes a plurality of (two shown in FIG. 1A) threaded holes 121*f*. Two cylindrical supports 12*c* are arranged on an outer surface of the end wall 12*a*. Each support 12*c* includes a threaded hole 121*c*.

A circuit board 20*a* of an inverter 20 is arranged on the two supports 12*c*. The supports 12*c* support the circuit board 20*a* in a state separated from the end wall 12*a*. The circuit board 20*a* is arranged so that its mounting surface is orthogonal to the axial direction of the rotary shaft 19. A drive control circuit (i.e., inverter circuit) for the electric motor 16 is arranged on the circuit board 20*a*. Switching elements, filter coils, and capacitors (not shown) are also electrically connected to the circuit board 20*a*. The circuit board 20*a* includes two insertion holes 20*b*. A bolt B1 is inserted through each insertion hole 20*b* and fastened to the threaded hole 121*c* of the corresponding support 12*c*. This fixes the circuit board 20*a* to the supports 12*c*.

Figure 1B:
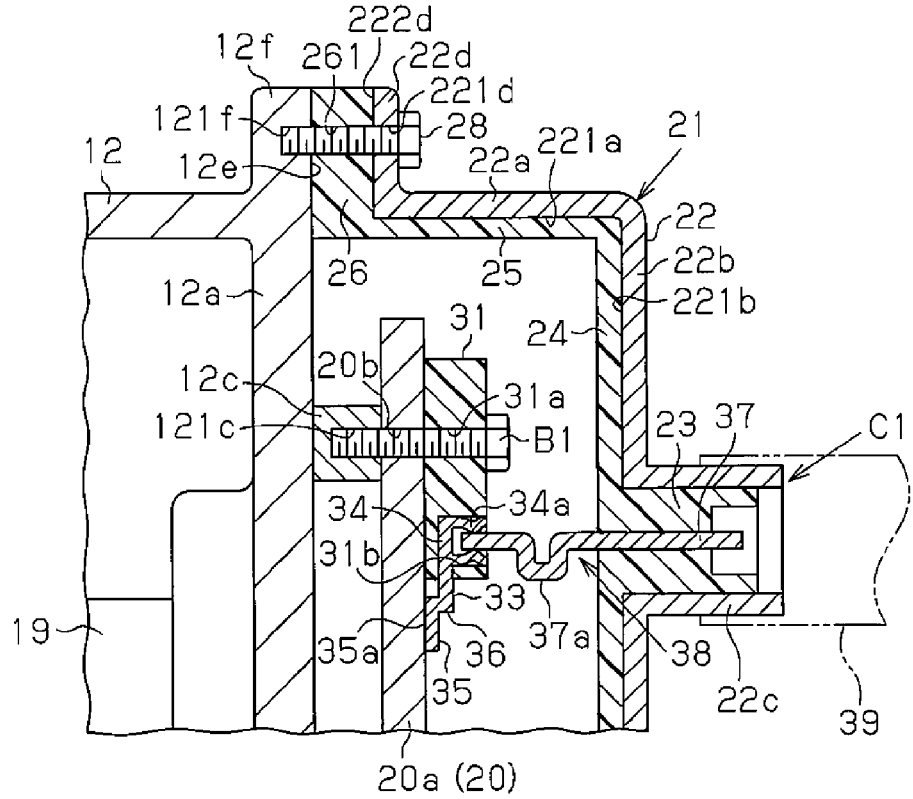
FIG. 1B is a partial enlarged cross-sectional view of FIG. 1A showing a lead.

Referring to FIG. 1B, an inverter cover 21, which is open at one side, is fixed to the end wall 12*a* of the suction housing 12 to accommodate and cover the inverter 20 (circuit board 20*a*). The inverter cover 21 includes a metal cover 22, which is formed form aluminum and serves as a frame of the inverter cover 21. The metal cover 22 includes a tubular portion 22*a* and an end portion 22*b*. The tubular portion 22*a* is cylindrical and extends in the axial direction of the rotary shaft 19. The end portion 22*b* extends inward in a direction perpendicular to the direction in which the tubular portion 22*a* extends from the end of the tubular portion 22*a* facing away from the suction housing 12. The metal cover 22 includes a cylindrical connector coupler 22*c*, which is continuous with the end portion 22*b* and extends in the axial direction of the rotary shaft 19.

The metal cover 22 also includes an annular metal cover flange 22*d*, which extends outward perpendicular to the direction in which the tubular portion 22*a* extends from the end of the tubular portion 22*a* facing toward the suction housing 12. The metal cover flange 22*d* includes insertion holes 221*d* aligned with the threaded holes 121*f* of the flange 12*f*. The metal cover 22 is arranged to encompass the circuit board 20*a*.

The connector coupler 22*c* accommodates a resin holder 23, which is arranged integrally with the connector coupler 22*c*. An inner end insulator 24, which is formed from a resin, is arranged integrally with the metal cover 22 on an inner surface 221*b* of the end portion 22*b*. The inner end insulator 24 extends continuously from the holder 23 along the inner surface 221*b* of the end portion 22*b*. An inner circumferential insulator 25, which is formed from a resin, is arranged integrally with the metal cover 22 on an inner surface 221*a* of the tubular portion 22*a*. The inner circumferential insulator 25 extends continuously from the inner end insulator 24 along the inner surface 221*a* of the tubular portion 22*a*.

A seal flange 26, which is formed from a resin, is arranged integrally with the metal cover 22 on an end surface 222*d* of the metal cover flange 22*d*. The seal flange 26 extends continuously from the inner circumferential insulator 25 at the end facing toward the suction housing 12 along the end surface 222*d* of the metal cover flange 22*d*. The seal flange 26 includes insertion holes 261 aligned with the threaded holes 121*f* of the flange 12*f* and the insertion holes 221*d* of the metal cover flange 22*d*. In the present embodiment, the metal cover 22, the holder 23, the inner end insulator 24, the inner circumferential insulator 25, and the seal flange 26 form the inverter cover 21.

Bolts 28 are inserted through the insertion holes 221*d* of the metal cover flange 22*d* and the insertion holes 261 of the seal flange 26 and fastened to the threaded holes 121*f* of the flange 12*f* to fix the inverter cover 21 to the end wall 12*a* of the suction housing 12. The seal flange 26, which is arranged between the metal cover flange 22*d* and the flange 12*f*, hermetically seals the gap between the end surface 222*d* of the metal cover flange 22*d* and an end surface 12*e* of the flange 12*f*.

The circuit board 20*a* includes a front surface (first surface) and a rear surface (second surface). A resin connector 31 is coupled to the front surface. The resin connector 31 includes an insertion hole 31*a*. A bolt B1 is inserted through the insertion hole 31*a* of the resin connector 31 and one of the insertion holes 20*b* of the circuit board 20*a* and fastened to the threaded hole 121*c* of the corresponding support 12*c*. This fixes the resin connector 31 to the front surface of the circuit board 20*a*.

The resin connector 31 includes a connection terminal 33. The connection terminal 33 includes a first connection terminal portion 34, which extends parallel to the front surface of the circuit board 20*a* and is mostly embedded in the resin connector 31. The first connection terminal portion 34 includes one end (distal end) defining a connecting portion 34*a* and another end (basal end) projecting out of the resin connector 31. The resin connector 31 includes an accommodation recess 31*b* that accommodates the connecting portion 34*a*.

Further, the connection terminal 33 includes a second connection terminal portion 35, which is continuous with the basal end of the first connection terminal portion 34 and extends parallel to the front surface of the circuit board 20*a*. A step 36 is formed between the first connection terminal portion 34 and the second connection terminal portion 35. The second connection terminal portion 35 is located closer to the circuit board 20*a* than the first connection terminal portion 34. The second connection terminal portion 35 includes a surface facing toward the circuit board 20*a* that defines a solder bonding surface 35*a* (solder bonding portion), which solders the circuit board 20*a* and the second connection terminal portion 35. A reflow process is performed to solder the circuit board 20*a* and the solder bonding surface 35*a* of the second connection terminal portion 35.

Figure 2A:
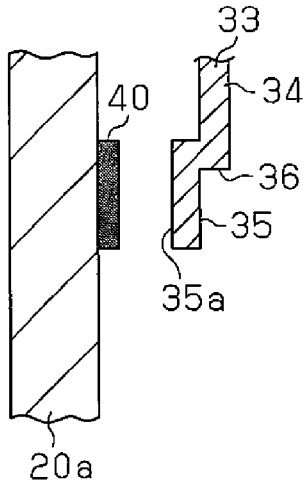
FIG. 2A is an enlarged cross-sectional view of FIG. 1A showing solder applied to a circuit board.
Figure 2B:
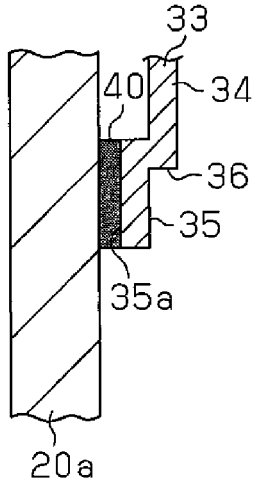
FIG. 2B is an enlarged cross-sectional view showing a solder bonding surface of a second connection terminal portion arranged on the solder.
Figure 2C:
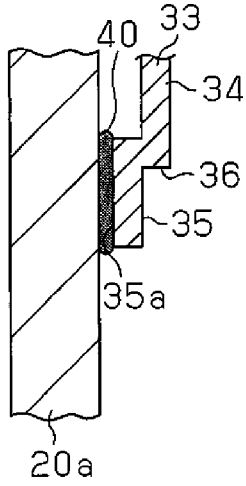
FIG. 2C is an enlarged cross-sectional view showing the solder bonding surface of the second connection terminal portion soldered to the circuit board through a reflow process.

Referring to FIG. 2A, to solder the circuit board 20*a* and the solder bonding surface 35*a* of the second connection terminal portion 35 in the reflow process, a paste of solder 40 is first applied to the front surface of the circuit board 20*a*. Then, referring to FIG. 2B, the solder bonding surface 35*a* of the second connection terminal portion 35 is placed on the solder 40. Subsequently, the circuit board 20*a* is arranged in a reflow furnace and heated to a maximum temperature of approximately 260° C. This solders the circuit board 20*a* and the solder bonding surface 35*a* of the second connection terminal portion 35, as shown in FIG. 2C. In this manner, the circuit board 20*a* and the second connection terminal portion 35 are electrically connected by soldering the circuit board 20*a* and the solder bonding surface 35*a* of the second connection terminal portion 35.

Referring to FIG. 1B, the connecting portion 34*a* is connected to one end (basal end) of a rod-shaped metal terminal 37. The holder 23 holds the other end (distal end) of the metal terminal 37 to electrically insulate the metal terminal 37 and the metal cover 22 (connector coupler 22*c*). The metal terminal 37 is formed integrally with the holder 23 and thereby arranged integrally with the holder 23.

A U-shaped deformation portion 37*a* is formed between the basal and distal ends of the metal terminal 37. The metal terminal 37 is easily deformed from the deformation portion 37*a*. When the inverter cover 21, which is arranged integrally with the metal terminal 37 and the holder 23, is fixed to the suction housing 12, the basal end of the metal terminal 37 is connected to the connecting portion 34*a*.

The distal end of the metal terminal 37, which is exposed from the holder 23 in the connector coupler 22*c*, is electrically connected to a connection terminal (not shown) of a power supplying external connector 39 (indicated by double-dashed lines in FIGS. 1A and 1B), which is connected to the connector coupler 22*c*. This electrically connects the external connector 39 to the circuit board 20*a* via the metal terminal 37 and the connection terminal 33 and forms a structure for connecting the metal terminal 37 and the connection terminal 33. Accordingly, in the present embodiment, the metal terminal 37 and the connection terminal 33 form a lead 38 that electrically connects the circuit board 20*a* and the external connector 39. Further, the lead 38, the connector coupler 22*c*, and the holder 23 form a connector C1 that is connected to the external connector 39.

When the circuit board 20*a* is supplied with power from the external connector 39 through the metal terminal 37 and connection terminal 33 (i.e., lead 38), the drive control circuit of the circuit board 20*a* supplies power to the electric motor 16, rotates the rotor 18 and rotary shaft 19 at a controlled rotation speed, and drives the compression unit 15. As a result, the compression unit 15 draws refrigerant into the suction housing 12 through the suction port from the external refrigerant circuit, compresses the refrigerant in the suction housing 12 with the compression unit 15, and discharges the compressed refrigerant to the external refrigerant circuit through the discharge port 14.

The operation of the present embodiment will now be described.

When connecting the external connector 39 to the connector coupler 22*c*, a connection terminal of the external connector 39 is fitted to the metal terminal 37. This applies stress to the circuit board 20*a* through the metal terminal 37 and the connection terminal 33. Here, the rear surface of the circuit board 20*a* is supported by the supports 12*c*. Thus, the supports 12*c* receive the stress applied to the circuit board 20*a*. When disconnecting the external connector 39 from the connector coupler 22*c*, the removal of the connection terminal of the external connector 39 from the metal terminal 37 applies a force to the metal terminal 37 acting to pull the metal terminal 37 toward the external connector 39. This force is transmitted to the circuit board 20*a* through the metal terminal 37 and the connection terminal 33. However, in the present embodiment, the circuit board 20*a* is fastened by the bolts B1 to the supports 12*c*. Thus, the circuit board 20*a* is not pulled toward the external connector 39. Accordingly, in the present embodiment, the supports 12*c* and the bolts B1 form a stress dampening unit that dampens the stress applied to the circuit board 20*a* through the metal terminal 37 and the connection terminal 33 when the connection terminal of the external connector 39 is fitted to and removed from the metal terminal 37.

Further, the holder 23 integrally holds the metal terminal 37. Thus, when the connection terminal of the external connector 39 is fitted to and removed from the metal terminal 37, movement of the metal terminal 37 in the fitting and removal direction is restricted. Further, the application of stress to the circuit board 20*a* through the metal terminal 37 is suppressed. Thus, in the present embodiment, in addition to the supports 12*c* and the bolts B1, the holder 23 also functions as part of the stress dampening unit.

Moreover, when the connection terminal of the external connector 39 is fitted to and removed from the metal terminal 37, the deformation portion 37*a* deforms so that the stress acting on the circuit board 20*a* through the metal terminal 37 and the connection terminal 33 is subtle. Thus, in the present embodiment, the deformation portion 37*a* also functions as part of the stress dampening unit in addition to the supports 12*c*, the bolts B1, and the holder 23.

The above embodiment has the advantages described below.

(1) The holder 23 integrally holds the metal terminal 37 of the lead 38. Thus, when the connection terminal of the external connector 39 is fitted to or removed from the metal terminal 37, movement of the metal terminal 37 in the fitting and removing direction is restricted. This suppresses the application of stress applied to the circuit board 20*a* through the metal terminal 37.

(2) The deformation portion 37*a* is arranged in the metal terminal 37 of the lead 38 between the circuit board 20*a* and the holder 23. The deformation portion 37*a* deforms when the connection terminal of the external connector 39 is fitted to or removed from the metal terminal 37. Thus, the stress acting on the circuit board 20*a* through the metal terminal 37 and the connection terminal 33 is subtle. Further, the circuit board 20*a* and the holder 23 are each provided with a dimensional tolerance. Such dimensional tolerance is absorbed as the deformation portion 37*a* deforms when the metal terminal 37, which is held by the holder 23, is connected to the connecting portion 34*a*. This facilitates the connection of the metal terminal 37 and the connecting portion 34*a*.

(3) The stress dampening unit includes the supports 12*c*, which support the circuit board 20*a* from the rear side of the circuit board 20*a*, and the bolts B1, which fasten the circuit board 20*a* to the supports 12*c*. Since the rear surface of the circuit board 20*a* is supported by the supports 12*c*, when the external connector 39 is fitted to the lead 38, the supports 12*c* receive the stress applied to the circuit board 20*a* through the lead 38. Further, the circuit board 20*a* is fastened to the supports 12*c* by the bolts B1 and prevented from being pulled toward the external connector 39 when the external connector 39 is pulled off the lead 38. In this manner, the stress applied to the circuit board 20*a* through the lead 38 is dampened when the external connector 39 is fitted to and removed from the lead 38.

(4) The circuit board 20*a* and the solder bonding surface 35*a* of the second connection terminal portion 35 are soldered through a reflow process to electrically connect the circuit board 20*a* and the lead 38. For example, subsequent to the insertion of a lead into an insertion hole formed in the circuit board 20*a*, a soldering iron may be used to solder the circuit board 20*a* and the lead. In this case, soldering is performed on opposite sides of the circuit board with the soldering iron after the lead is inserted into the insertion hole of the circuit board 20*a*. In contrast, in the present embodiment, after applying the solder 40 to the front surface of the circuit board 20*a*, the solder bonding surface 35*a* of the second connection terminal portion 35 is arranged on the solder 40. Then, the circuit board 20*a* is arranged in a reflow furnace and heated. This solders the circuit board 20*a* and the solder bonding surface 35*a* of the second connection terminal portion 35. Thus, there is no need to perform soldering with a soldering iron on opposite sides of the circuit board 20*a* like when soldering the circuit board 20*a* and lead with a soldering iron. This reduces the soldering steps.

(5) The circuit board 20*a* is fixed to the supports 12*c* by fastening the bolts B1 to the threaded holes 121*c* of the supports 12*c*. Thus, the heat generated from the circuit board 20*a* can be radiated toward the suction housing 12 through the bolts B1 and the supports 12*c*.

(6) The inverter cover 21 is formed by the metal cover 22 in addition to the holder 23, the inner end insulator 24, the inner circumferential insulator 25, and the seal flange 26. At the same time as when the inverter cover 21 is fixed to the end wall 12*a* of the suction housing 12, the seal flange 26 is held between the metal cover flange 22*d* and the flange 12*f*. Thus, the seal flange 26 hermetically seals the gap between the end surface 222*d* of the metal cover flange 22*d* and the end surface 12*e* of the flange 12*f* just by fixing the inverter cover 21 to the suction housing 12. Accordingly, there is no need to provide a separate seal to seal the gap between the end surface 222*d* of the metal cover flange 22*d* and the end surface 12*e* of the flange 12*f*. This reduces the number of components and facilitates assembly.

(7) The metal terminal 37 of the lead 38 is arranged integrally with the holder 23. This ensures the hermetic seal between the metal terminal 37 and the holder 23.

Second Embodiment

A second embodiment of the present invention will now be described with reference to FIGS. 3 and 4. In the description hereafter, like or same reference numerals are given to those components that are the same as the corresponding components of the first embodiment. Such components will not be described in detail.

Figure 3:
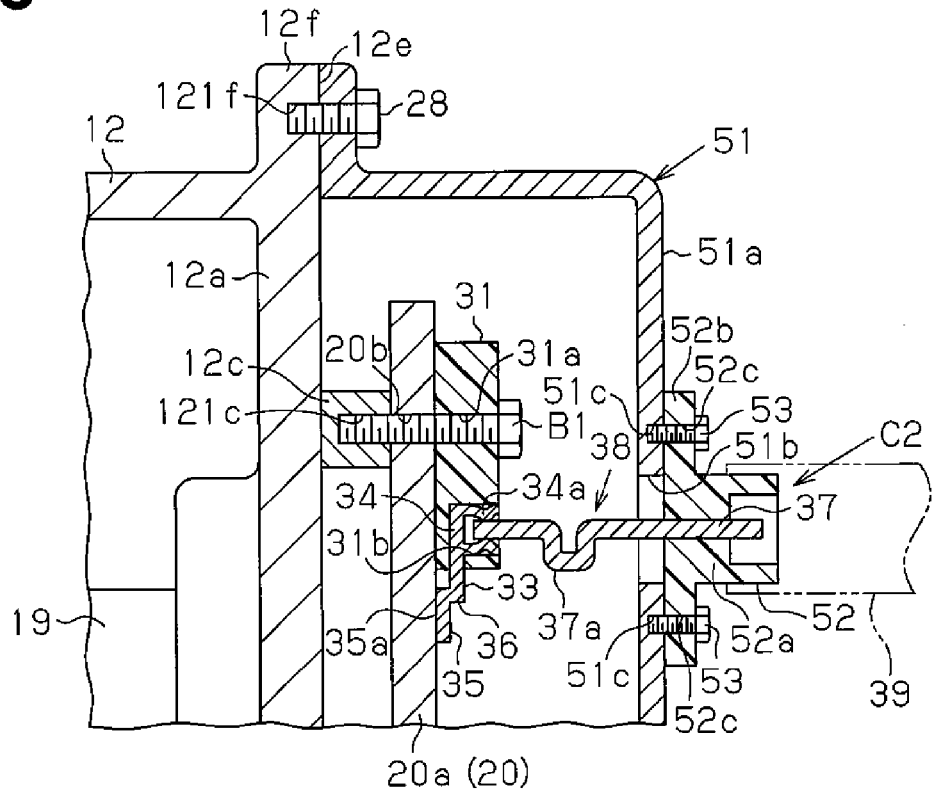
FIG. 3 is a partially enlarged cross-sectional view showing a lead according to a second embodiment of the present invention.
Figure 4:
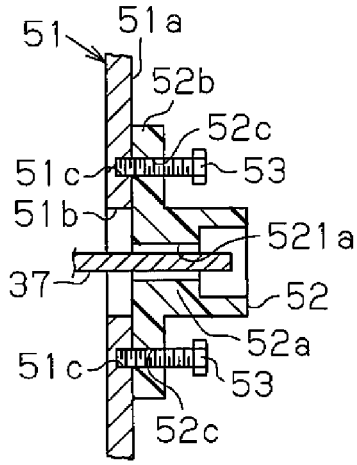
FIG. 4 is an enlarged cross-sectional view showing a state prior to the sandwiching of a metal terminal of FIG. 3.

Referring to FIG. 3, an inverter cover 51 is fixed to the end wall 12*a* of the suction housing 12. The inverter cover 51, which has one open side, accommodates the inverter (circuit board 20*a*). The inverter cover 51 is formed from aluminum. An insertion hole 51*b* extends through an end wall 51*a* of the inverter cover 51. The distal portion of the metal terminal 37 extends through the insertion hole 51*b* and out of the inverter cover 51. The outer surface of the end wall 51*a* includes two threaded holes 51*c*.

A resin connector coupler 52 is arranged on the inverter cover 51. The connector coupler 52 is coupled to the outer surface of the end wall 51*a* to close the insertion hole 51*b*. The connector coupler 52 includes a holder 52*a*, which holds the distal portion of the metal terminal 37, and a flange 52*b*, which is continuous with the holder 52*a* and extends outward along the outer surface of the end wall 51*a* from the holder 52*a*. The flange 52*b* includes two threaded holes 52*c*, which are aligned with the corresponding threaded holes 51*c* of the inverter cover 51. Bolts 53 are fastened to the threaded holes 52*c* of the flange 52*b* and the corresponding threaded holes 51*c* of the inverter cover 51 to fix the connector coupler 52 to the end wall 51*a* of the inverter cover 51.

The distal portion of the metal terminal 37 is held in a state sandwiched by part of the holder 52*a*. Referring to FIG. 4, before the distal portion of the metal terminal 37 is sandwiched by the holder 52*a*, the distal portion of the metal terminal 37 is held in a state extended through an insertion hole 521*a* of the holder 52*a*. When coupling the connector coupler 52 to the end wall 51*a* of the inverter cover 51, as the bolts 53 are fastened to the threaded holes 52*c* of the flange 52*b*, a spring (not shown) arranged in the holder 52*a* urges part of the holder 52*a* to fill the gap between the wall of the insertion hole 521*a* and the metal terminal 37. As a result, the distal portion of the metal terminal 37 is held in a state sandwiched by part of the holder 52*a*. In this manner, in the present embodiment, the lead 38 and the connector coupler 52 form a connector C2, which is connected to the external connector 39.

The operation of the second embodiment will now be described.

When connecting the external connector 39 to the connector coupler 52, the connection terminal of the external connector 39 is fitted to the metal terminal 37. This applies force to the metal terminal 37 acting to move the metal terminal 37 toward the circuit board 20*a* along the fitting and removing direction. However, the distal portion of the metal terminal 37 is held in a state sandwiched by the holder 52*a*. This restricts movement of the metal terminal 37 toward the circuit board 20*a* along the fitting and removing direction. Further, when the connection terminal of the external connector 39 is removed from the metal terminal 37, force is applied to the metal terminal 37 acting to pull the metal terminal 37 toward the external connector 39. However, the distal portion of the metal terminal 37 is held in a state sandwiched by the holder 52*a*. This restricts movement of the metal terminal 37 toward the external connector 39 along the fitting and removing direction. In this manner, in the second embodiment, in addition to the supports 12*c* and the bolts B1, the holder 52*a* also functions as part of the stress dampening unit.

In addition to advantages (1) to (5) and (7) of the first embodiment, the second embodiment has the following advantage.

(8) The metal terminal 37 of the lead 38 is held in a state sandwiched by the holder 52*a*. This increases the holding force applied by the holder 52*a* to the metal terminal 37. Thus, when the external connector 39 is fitted to and removed from the metal terminal 37, movement of the metal terminal 37 in the fitting and removing direction is further easily restricted.

Third Embodiment

A third embodiment of the present invention will now be described with reference to FIG. 5.

Figure 5:
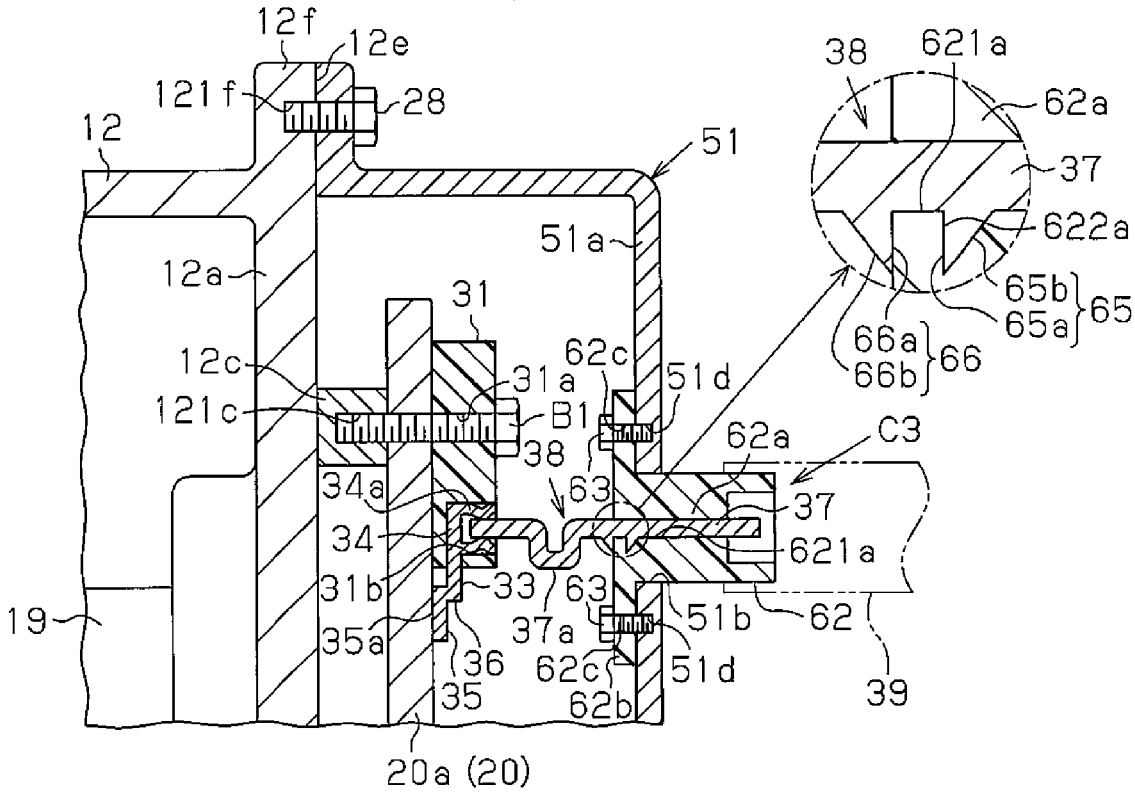
FIG. 5 is a partially enlarged cross-sectional view showing a lead according to a third embodiment of the present invention.

Referring to FIG. 5, an inverter cover 51, which is similar to that of the second embodiment, is fixed to the end wall 12*a* of the suction housing 12. The inner surface of the end wall 51*a* of the inverter cover 51 includes two threaded holes 51*d*.

A resin connector coupler 62 projects out of the inverter cover 51 from the insertion hole 51*b*. The connector coupler 62 includes a holder 62*a*, which holds the distal portion of the metal terminal 37, and a flange 62*b*, which is continuous with the holder 62*a* and extends outward along the inner surface of the end wall 51*a* from the holder 62*a*. The flange 62*b* includes two threaded holes 62*c*, which are aligned with the corresponding threaded holes 51*d* of the inverter cover 51. Bolts 63 are fastened to the threaded holes 62*c* of the flange 62*b* and the corresponding threaded holes 51*d* of the inverter cover 51 to fix the connector coupler 52 to the end wall 51*a* of the inverter cover 51. The holder 62*a* includes an insertion hole 621*a* into which the distal end of the metal terminal 37 can be inserted.

As show by the enlarged view in FIG. 5, a first hook 65 and a second hook 66 extend from the outer surface of the metal terminal 37. The first and second hooks 65 and 66 can be hooked to the holder 62*a*. The first hook 65 is located closer to the distal end of the metal terminal 37 than the second hook 66.

The first hook 65 includes a first hooking surface 65*a*, which extends in a direction perpendicular to the axial direction of the metal terminal 37, and a first insertion surface 65*b*, which connects the first hooking surface 65*a* to the outer surface of the metal terminal 37 and is inclined toward the distal end of the metal terminal 37 from the first hooking surface 65*a*. The second hook 66 includes a second hooking surface 66*a*, which extends in a direction perpendicular to the axial direction of the metal terminal 37, and a second insertion surface 66*b*, which connects the second hooking surface 66*a* to the outer surface of the metal terminal 37 and is inclined toward the basal end of the metal terminal 37 from the second hooking surface 66*a*.

The distal portion of the metal terminal 37 is forcibly inserted into the insertion hole 621*a* of the holder 62*a* from the side of the first insertion surface 65*b*. This hooks the first hooking portion 65 to a hooked recess 622*a*, which is formed in the wall surface of the insertion hole 621*a*. Further, the second hooking surface 66*a* of the second hook 66 is hooked to the surface of the holder 62*a* facing toward the circuit board 20*a*. This holds the metal terminal 37 in a state hooked to the holder 62*a*. In the present embodiment, the lead 38 and the connector coupler 62 form a connector C3, which is connected to the external connector 39.

The operation of the third embodiment will now be described.

When connecting the external connector 39 to the connector coupler 62, the connection terminal of the external connector 39 is fitted to the metal terminal 37. This applies force to the metal terminal 37 acting to move the metal terminal 37 toward the circuit board 20*a* along the fitting and removing direction. However, the first hooking surface 65*a* of the first hook 65 is hooked to the hooked recess 622*a* in the wall surface of the insertion hole 621*a*. This restricts movement of the metal terminal 37 toward the circuit board 20*a* along the fitting and removing direction. Further, when the connection terminal of the external connector 39 is removed from the metal terminal 37, force is applied to the metal terminal 37 acting to pull the metal terminal 37 toward the external connector 39. However, the second hooking surface 66*a* of the second hook 66 is hooked to the surface of the holder 62*a* facing toward the circuit board 20*a*. This restricts movement of the metal terminal 37 toward the external connector 39 along the fitting and removing direction. In this manner, in the third embodiment, the first hook 65, the second hook 66, and the holder 62*a* also function as part of the stress dampening unit in addition to the supports 12*c* and the bolts B1.

In addition to advantages (1) to (5) and (7) of the first embodiment, the third embodiment has the advantages described below.

(8) The metal terminal 37 of the lead 38 includes the first and second hooks 65 and 66 that can be hooked to the holder 62*a*. The first and second hooks 65 and 66, which are hooked to the holder 62*a*, restricts movement of the metal terminal 37 in the fitting and removing direction when the external connector 39 is fitted to and removed from the metal terminal 37. This suppresses the application of stress to the circuit board 20*a* through the lead 38.

It should be apparent to those skilled in the art that the present invention may be embodied in many other specific forms without departing from the spirit or scope of the invention. Particularly, it should be understood that the present invention may be embodied in the following forms.

Figure 6:
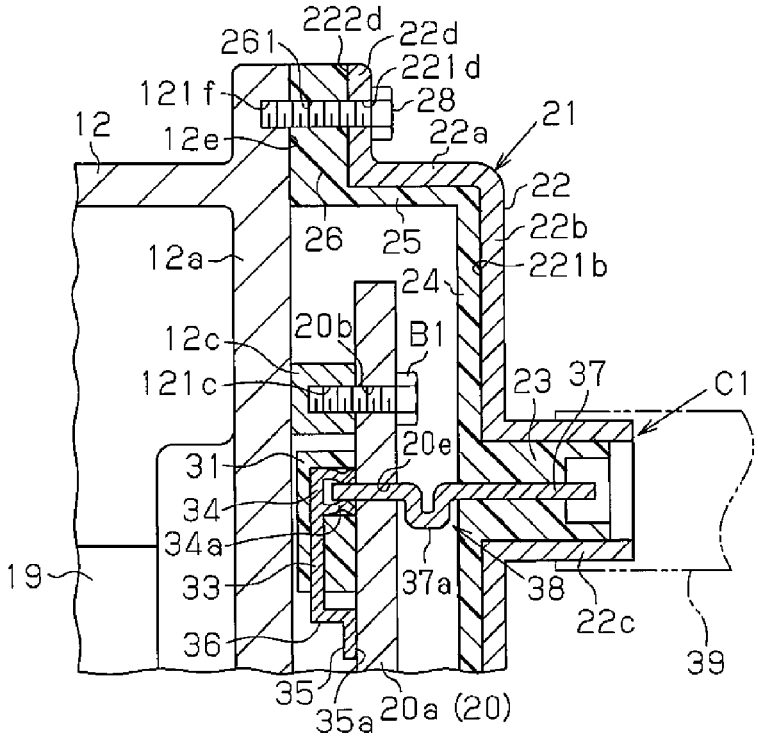
FIG. 6 is a partially enlarged cross-sectional view showing a lead in a further embodiment.

Referring to FIG. 6, the resin connector 31 may be coupled to the rear surface of the circuit board 20*a*. As shown in FIG. 6, the metal terminal 37 is extended through an insertion hole 20*e* formed in the circuit board 20*a* and includes one end connected to the connecting portion 34*a*. This allows the space between the inverter cover 21 and the circuit board 20*a* to be minimized. In this case, the inner end insulator 24 is required to ensure insulation between the metal cover 22 and the circuit board 20*a*.

Figure 7:
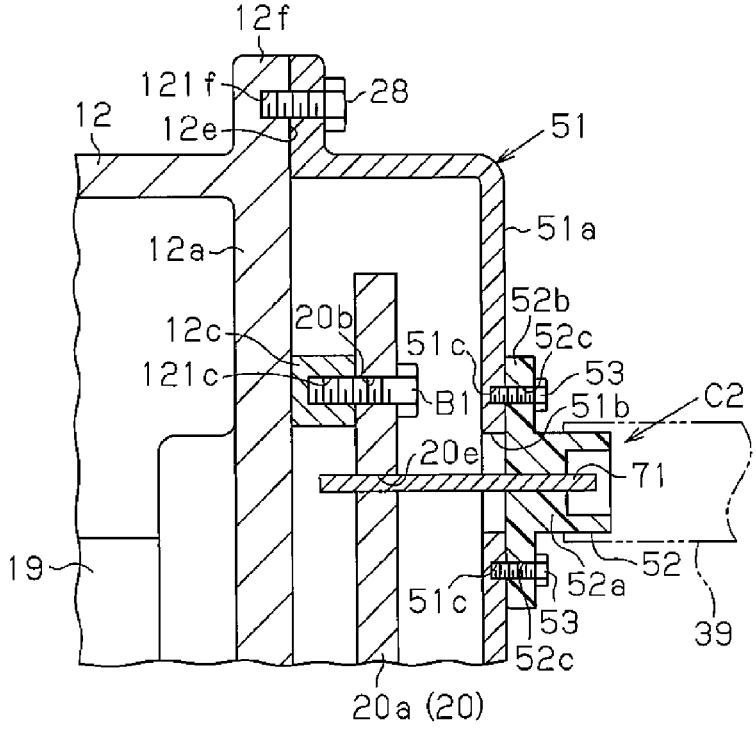
FIG. 7 is a partially enlarged cross-sectional view showing a lead in another embodiment.
Figure 8A:
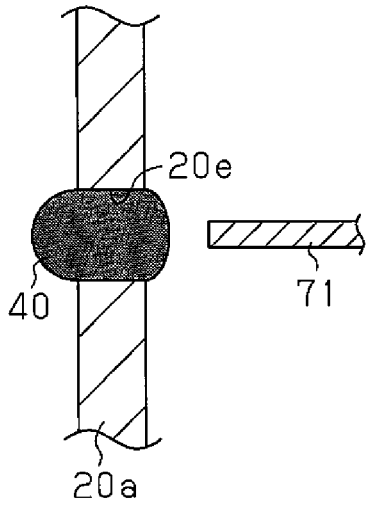
FIG. 8A is an enlarged cross-sectional view showing an insertion hole filled with solder.
Figure 8B:
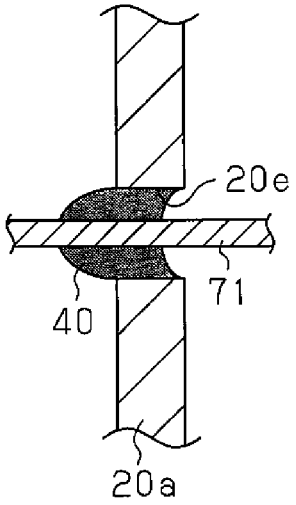
FIG. 8B is an enlarged cross-sectional view showing a lead inserted into the insertion hole.
Figure 8C:
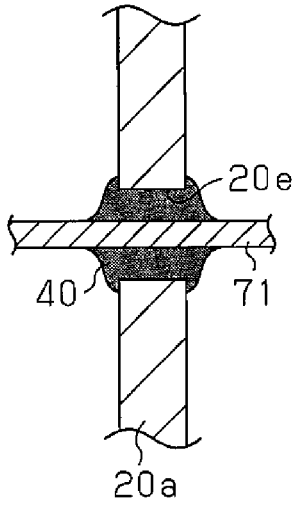
FIG. 8C is an enlarged cross-sectional view showing the lead soldered to a circuit board through a reflow process.

In the above embodiments, a reflow process is performed to solder the circuit board 20*a* and the solder bonding surface 35*a* of the second connection terminal portion 35 to electrically connect the circuit board 20*a* and the lead 38. However, the present invention is not limited in such a manner. For example, as shown in FIG. 7, one end of a straight rod-shaped lead 71 may be inserted into an insertion hole 20*e* formed in the circuit board 20*a*, and a reflow process may be performed to solder the circuit board 20*a* and the lead 71. More specifically, as shown in FIG. 8A, solder 40 is first filled in the insertion hole 20*e* of the circuit board 20*a*. Then, as shown in FIG. 8B, one end of the lead 71 is extended through the solder 40 in the insertion hole 20*e*. As the lead 71 advances through the solder 40, the solder 40 is entirely moved in the direction the lead 71 is inserted. Subsequently, the circuit board 20*a* is arranged in a reflow furnace and heated to a maximum temperature of approximately 260° C. As shown in FIG. 8C, the solder 40, which has been moved in the insertion direction of the lead 71, is moved by surface tension along the wall surface of the insertion hole 20*e* into the space between the outer surface of the lead 71 and the insertion hole 20*e*. Then, the solder 40 is cooled and solidified thereby soldering the circuit board 20*a* and the lead 71. Afterward, as shown in FIG. 7, the bolts B1 fasten the circuit board 20*a* to the supports 12*c*, and the inverter cover 51 is coupled to the end wall 12*a* of the suction housing 12. Further, the connector coupler 52 is coupled to the outer surface of the end wall 51*a* of the inverter cover 51 to cover the insertion hole 51*b* of the inverter cover 51. In this state, the distal portion of the lead 71 is held in a state sandwiched by part of the holder 52*a*.

In the above embodiments, the supports 12*c* do not have to support the circuit board 20*a* from the rear surface of the circuit board 20*a*, and the bolts B1 do not have to fasten the circuit board 20*a* to the supports.

In the above embodiments, the deformation portion 37*a* may be omitted.

In the above embodiments, the metal terminal 37 does not have to be held by the holders 23, 52*a*, and 62*a*.

In the above embodiments, the inverter covers 21 and 51 may entirely be formed from a resin.

In the above embodiments, the external connector 39 does not have to be used to supply power and may be used, for example, to output signals of a sensor.

The present invention is embodied in a structure for connecting the external connector 39 and the circuit board 20*a*, which drives and controls the electric motor 16 installed in an electric compressor 10.

The present examples and embodiments are to be considered as illustrative and not restrictive, and the invention is not to be limited to the details given herein, but may be modified within the scope and equivalence of the appended claims.

The invention claimed is:

1. A structure for connecting a circuit board and an external connector, the structure comprising:

a lead that electrically connects the circuit board and the external connector, wherein the external connector is fitted to and removed from the lead; and a stress dampening unit that dampens stress applied to the circuit board by the lead when the external connector is fitted to and removed from the lead;

a housing that accommodates a drive unit driven when supplied with power from the circuit board; and a cover fixed to the housing, wherein the cover accommodates the circuit board, the cover includes a connector coupler, which is connected with the external connector, and a holder, which integrally holds the lead, the external connector is connected to the connector coupler to electrically connect the external connector to the lead, and the holder functions as the stress dampening unit.

2. The structure according to claim 1, wherein the lead is held in a state sandwiched in the holder.

3. The structure according to claim 1, wherein the lead includes a hook hooked to the holder, and the hook functions as the stress dampening unit.

4. The structure according to claim 1, wherein the lead includes a deformation portion located between the circuit board and the holder.

5. The structure according to claim 1, wherein the circuit board includes a first surface and an opposite second surface, the lead extends from the first surface of the circuit board to a portion connected to the external connector, and the stress dampening unit includes a support supporting the second surface of the circuit board, and a fastener fastening the circuit board to the support.

6. The structure according to claim 1, wherein the circuit board and the lead are soldered through a reflow process and electrically connected.

7. An electric compressor comprising:

a compression unit that compresses refrigerant, a drive unit that drives the compression unit, an inverter that includes a circuit board for supplying power to the drive unit, wherein the compression unit, the drive unit and the inverter are arranged in this order;

a housing that accommodates the compression unit and the drive unit;

a rotary shaft extending in the housing along an axial direction;

a cover that accommodates the inverter and is fixed to the housing, wherein the cover is provided with a connector coupler to which an external connector is connected, and the connector coupler is continuous from the cover and extends opposite to the drive unit along the axial direction;

a holder provided with the cover;

a lead that extends from a first surface of the circuit board toward the connector coupler and electrically connects the circuit board and the external connector connected with the connector coupler, wherein the holder integrally holds the lead, the external connector is fitted to and removed from the lead, and the external connector is connected to the connector coupler to electrically connect the external connector to the lead;

a stress dampening unit that dampens stress applied to the circuit board by the lead when the external connector is fitted to and removed from the lead, wherein the stress dampening unit includes:

a plurality of supports that support a second surface of the circuit board opposite to the first surface;

a plurality of fasteners through which the circuit board is fixed to the plurality of supports; and the holder, wherein the lead includes a deformation portion located between the circuit board and the holder, and the connector coupler, the holder, and the deformation portion are arranged inside the plurality of supports and the plurality of fasteners.

8. A structure for connecting an external connector and a circuit board arranged in an electric compressor, the structure comprising:

a connector coupler provided with a cover, which accommodates the circuit board;

a holder provided with the cover;

a lead extending from a first surface of the circuit board toward the connector coupler and electrically connecting the circuit board with the external connector connected with the connector coupler, wherein the holder integrally holds the lead, and the lead includes:

a first end closer to the circuit board;

a second end held by the holder; and a deformation portion located between the first end and the second end;

a plurality of supports, which support the circuit board; and a plurality of fasteners, through which the circuit board is fixed to the plurality of supports; wherein the electric compressor includes a compression unit, which compresses refrigerant, a drive unit, which is supplied with power from the circuit board and drives the compression unit, and a housing, which accommodates the compression unit and the drive unit;

the housing has a wall closer to the drive portion in an axial direction;

the cover is fixed with an outer surface of the wall;

the connector coupler extends opposite to the housing from the cover in the axial direction;

the plurality of supports are arranged on the outer surface of the wall; and the lead and the connector coupler are arranged inside the plurality of supports in a planar direction of the circuit board.

* * * * *